United States Patent [19]

Kohata et al.

[11] Patent Number: 4,697,408

[45] Date of Patent: Oct. 6, 1987

[54] APPARATUS FOR CONTROLLING AMOUNT OF DELIVERY IN WRAPPING MATERIAL FEED SYSTEM

[75] Inventors: Toshihide Kohata; Masaru Miyazaki; Yoshihisa Sato; Junichi Ikeda, all of Tokyo, Japan

[73] Assignee: Japan Tobacco, Inc., Japan

[21] Appl. No.: 821,538

[22] Filed: Jan. 22, 1986

[30] Foreign Application Priority Data

Jan. 28, 1985 [JP] Japan ..... 60-012574

[51] Int. Cl.[4] ..... D01H 13/20

[52] U.S. Cl. ..... 57/264; 57/3; 57/90; 242/75.45

[58] Field of Search ..... 57/3, 6, 9, 10, 11, 57/13, 31, 210, 235, 260, 78, 80, 81, 90, 92, 93, 94, 264; 242/58, 65, 67.5, 75.45, 75.46, 75.47, 180, 181, 191, 196, 201, 203, 208, 216

[56] References Cited

U.S. PATENT DOCUMENTS

| | | | |
|---|---|---|---|
| 2,929,573 | 3/1960 | Haugwitz | 242/75.45 |
| 2,941,742 | 6/1960 | Willis | 242/58 |
| 3,063,228 | 11/1962 | Sarracino | 57/3 |
| 3,201,057 | 8/1965 | Ryan | 242/75.45 X |
| 3,526,244 | 9/1970 | Joy | 59/93 X |
| 4,346,550 | 8/1982 | Ferree | 57/10 |
| 4,497,164 | 2/1985 | Dotti et al. | 57/352 X |

*Primary Examiner*—Donald Watkins

*Attorney, Agent, or Firm*—Lowe, Price, LeBlanc, Becker & Shur

[57] ABSTRACT

An apparatus for controlling the amount of delivery in a wrapping material feed system, including a rotation drive means for rotating a bobbin with a wrapping material wound thereon; a winding diameter detecting means for detecting a winding diameter of the wrapping material; an adjusting means for changing torque and brake forces of the bobbin to adjust the amount of delivery of the wrapping material, and a control means for controlling the adjusting means. The control means has a memory section which stores optimum torque and brake forces for winding diameters of the wrapping material as well as increment and decrement patterns of torque and brake forces for various operation modes of the wrapping material feed system, and upon receipt of a signal from the winding diameter detecting means the control means provides a signal to the adjusting means in accordance with the contents of the memory section.

6 Claims, 12 Drawing Figures

APPARATUS FOR CONTROLLING AMOUNT OF DELIVERY IN WRAPPING MATERIAL FEED SYSTEM

BACKGROUND OF THE INVENTION

The present invention relates to an apparatus for controlling the amount of delivery in a wrapping material feed system.

As a wrapping material feed system for cutting a wrapping material into a predetermined size and sending it to a wrapping machine, there has been known a system of a construction in which two bobbins each with a wrapping material wound thereon are provided and the wrapping material on one bobbin is drawn out by a delivery roller, then after being cut into a predetermined size, it is sent to a wrapping machine, while switching is made to the other bobbin side when the volume of the wrapping material remaining on one bobbin becomes small.

According to the above wrapping material feed system, a plurality of tension rollers are disposed between the bobbins and the delivery roller to cope with variations in the amount of delivery of the wrapping materials at the time of starting or stopping operation or at the time of change-over from one bobbin to the other.

Recently, with speed-up of wrapping operation, studies have been made about enlarging the winding diameter of wrapping material to reduce the frequency of replacement of wrapping material also in wrapping material feed systems.

The larger the winding diameter of wrapping material, the larger the variation in the amount of delivery of wrapping material at the time of starting or stopping operation or at the time of change-over of bobbins, thus requiring a larger number of tension rollers to be provided.

However, disposing a larger number of tension rollers causes the problem of a larger space required and troublesome maintenance. Moreover, with tension rollers, there is a limit and it becomes impossible to cope with the increase in the winding diameter of wrapping material.

SUMMARY OF THE INVENTION

The present invention has been accomplished in view of the above-mentioned circumstances and it is the object thereof to provide an apparatus for controlling the amount of delivery in a wrapping material feed system capable of coping with an increase in the winding diameter of wrapping material.

In order to achieve the above object, the apparatus of the present invention includes a rotation drive means for rotating a bobbin with a wrapping material wound thereon; a winding diameter detecting means for detecting a winding diameter of the wrapping material; an adjusting means for changing torque and brake forces of the bobbin to adjust the amount of delivery of the wrapping material; and a control means for controlling the adjusting means, the controlling means having a memory section which stores optimum torque and brake forces for winding diameters of the wrapping material as well as increment and decrement patterns of torque and brake forces for various operation modes of a wrapping material feed system, in which upon receipt of a signal from the winding diameter detecting means the control means provides a signal to the adjusting means in accordance with the contents of the memory section.

The present invention also relies upon a transmission mechanism connected to an axis of the bobbin to transmit the torque of the bobbin without breaking the wrapping material.

BRIEF DESCRIPTION OF THE DRAWINGS

FIGS. 2 to 12 illustrate an embodiment of the present invention, of which:

FIG. 2 is a schematic front view of a rotation drive means and a winding diameter detecting means;

FIG. 3 is a side view of an adjusting means;

FIG. 4 is a block diagram of a control means;

FIG. 5 is a flowchart showing a winding diameter calculating routine;

FIG. 6 is an explanatory view showing contents of control of a powder clutch and a powder brake;

FIG. 7 is a timing chart;

FIGS. 8 to 12 are flowcharts showing operations of the control means.

DESCRIPTION OF A PREFERRED EMBODIMENT

An embodiment of the present invention will be described hereinunder with reference to the drawings.

Figure 1:
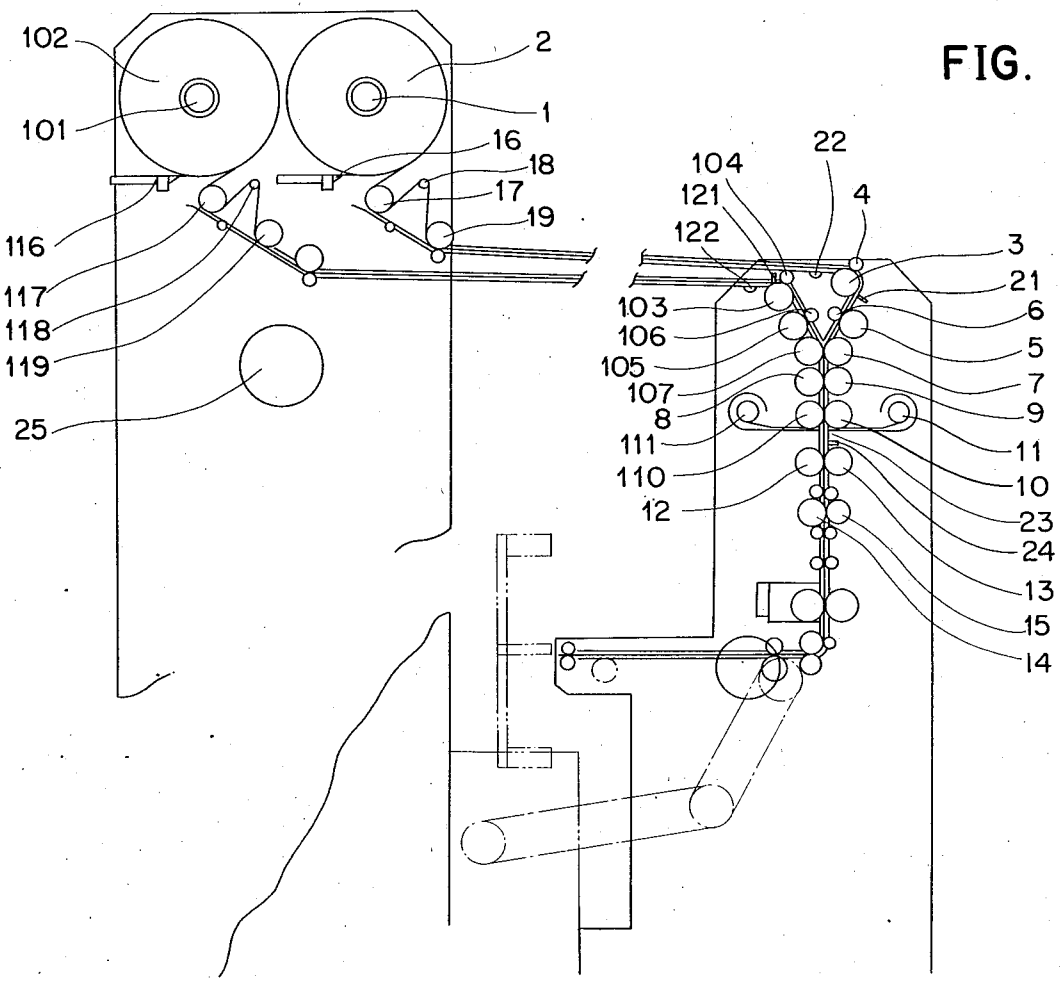
FIG. 1 is a schematic view of the whole of a wrapping material feed system provided with the delivery amount controlling apparatus of the present invention.

Referring first to FIG. 1, there is illustrated the whole of wrapping material feed system provided with the delivery amount controlling apparatus of the present invention, in which the reference numerals 1 and 101 denote bobbins; numerals 2 and 102 denote wrapping materials with pattern; numerals 3 and 103 denote direction changing feed rollers; numerals 4, 104, 6 and 106 denote receiving rollers; numerals 5 and 105 denote connection feed rollers; numerals 7 and 107 denote collection rollers; numeral 8 a connection knife roller; numeral 9 a connection knife receiving roller; numerals 10 and 110 suction separation rollers; numerals 11 and 111 take-up rollers; numeral 12 a feed roller; numeral 13 a receiving roller; numeral 14 a main knife roller; and numeral 15 a knife receiving roller.

The wrapping material 2 wound on the bobbin 1 is given a delivery force by the feed roller 12 and the receiving roller 13 and passes a preliminary feed suction roller 17, a tension roller 18 and a preliminary feed roller 19, then after its direction is changed by the direction changing feed roller 3, the wrapping material 2 passes a connection 20 (comprising the receiving rollers 6, 106, connection feed rollers 5, 105, connection knife roller 8, connection knife receiving roller 9, suction separation rollers 10, 110 and take-up rollers 11, 111). Then, a shear pattern is detected by a register mark detector 24, which shear is then corrected by the feed roller 12. Thereafter, the wrapping material is cut into a predetermined size by the main knife roller 14 and the knife receiving roller 15, then pasted and subsequently sent to a wrapping machine.

When the winding diameter of the wrapping material 2 on the bobbin 1 becomes smaller than a predetermined value, preparations are made for change-over to the other bobbin 101. More specifically, first the suction of the suction separation roller 110 and of the take-up roller 111 is turned ON, then the retreated state of the receiving roller 106 is released, then a drive motor (not shown) for the connection 20 is operated at a low speed. Then, a fore-end of the wrapping material 102 is stripped and drawn out from the bobbin 101 by means of a fore-end stripper 116 and is wound up onto the take-up roller 111 through a preliminary feed suction roller 117, tension roller 118, preliminary feed suction roller 119, direction changing feed roller 103, connection feed roller 105, collection roller 107 and suction separation roller 110. When this is detected by a take-up confirmation detector (not shown) and a register mark of the wrapping material 102 from the other bobbin 101 is detected by a coupling register mark detector 121, the drive motor of the connection 20 is stopped. Thereafter, a suction brake 122 is turned ON and the suction of the suction separation roller 110 and of the take-up roller 110 is turned OFF.

After completion of the preparations for change-over in this way and when the amount of the wrapping material 2 remaining on one bobbin 1 becomes small, there is performed a switching operation. More specifically, first a vertical moving guide 23 is moved up, then the clutch of the connection 20 is turned ON to start a constant-speed drive, and upon detection of a coupling register mark, the revolution of the connection feed roller 105 is increased or decreased by means of a differential gear (not shown). Further, a mechanical rotation angle of the apparatus is detected by a rotary encoder (connected to a shaft portion of gear which is in 1:1 relation to the revolution of the motor for driving the wrapping material feed system, as will be described later) and a mark registering is made between the wrapping material 2 on one bobbin 1 and the wrapping material 102 on the other bobbin 101. Then, the position of the edge of the connection knife roller 8 is detected by a photo switch (not shown) and the connection knife receiving roller 9 is rotated to push the wrapping material 2 on one bobbin 1 and the wrapping material 102 on the other bobbin 101 against the connection knife roller 8 thereby cutting the two simultaneously. Then, when the thus-cut portions reach the position of the main knife roller 14, the rear end of the wrapping material 2 from one bobbin 1 is advanced relative to the fore end of the wrapping material 102 from the other bobbin 101 to create a gap of about 0.8 mm between the two. Then, upon detection of a predetermined number (e.g. three) of mechanical revolutions of the apparatus by the rotary encoder, the clutch of the connection 20 is turned OFF, allowing the receiving roller 106 and the direction changing feed roller 103 to retreat, and the vertical moving guide 23 is brought down and returned to its original position. Thereafter, the fore end portion of the wrapping material 102 which has been taken up by the take-up roller 111 is discharged by means of an air cylinder (not shown), and the suction brake 22 is turned OFF and the bobbin 1 is reverse-rotated to recover the remaining piece of the wrapping material 2.

Figure 2:
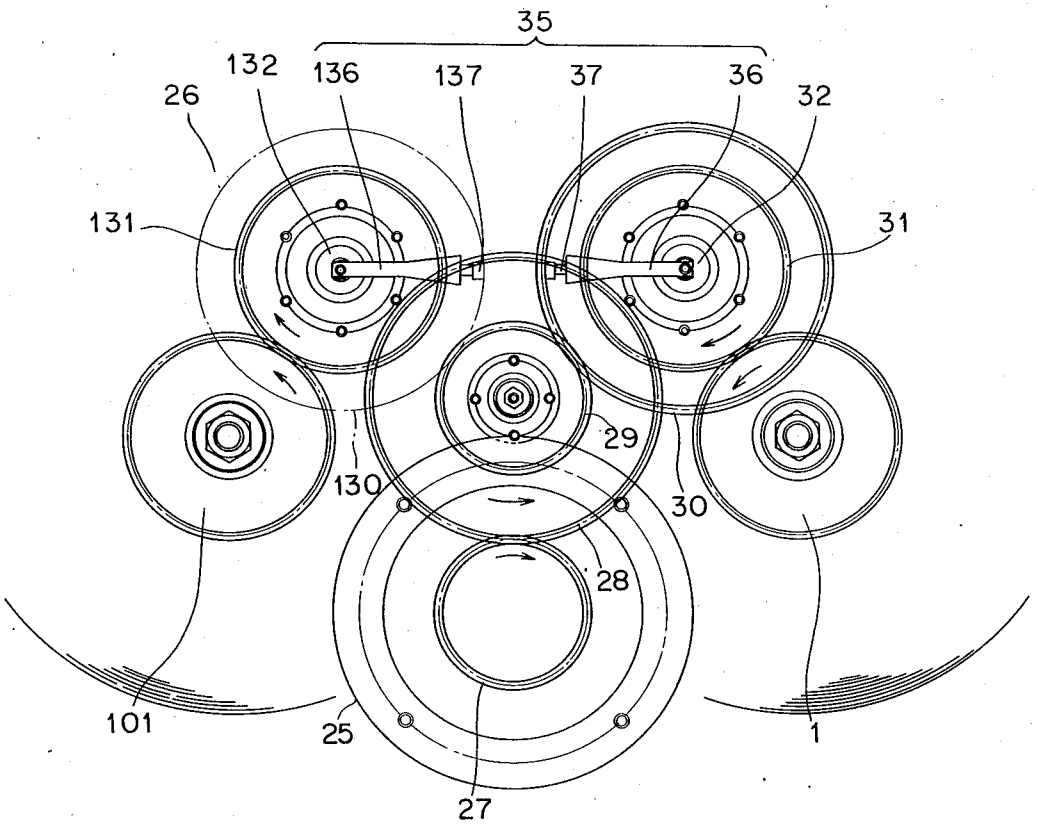

The above is an outline of the wrapping material feed system. Next, the following description is provided about the delivery amount controlling apparatus of the present invention for making control to minimize the variation in the amount of delivery of the wrapping materials 2 and 102 in various operation modes of the wrapping material feed system. FIG. 2 shows a motor 25 to produce a predetermined torque for rotating the bobbins 1 and 101 and a gear transmission mechanism 26 for transmitting said predetermined torque to the bobbins 1 and 101.

The gear transmission mechanism 26 is composed of a first common gear 28 engaged with a gear 27 mounted on a drive shaft of the motor 25; a second common gear 29 mounted coaxially with the first common gear 28; gears 30 and 130 which are in mesh with the second common gear 29; a gear 31 which is mounted coaxially with the gear 30 and which transfers the rotation of the motor 25 to one bobbin 1; and a gear 131 which is mounted coaxially with the gear 130 and which transfers the rotation of the motor 25 to the other bobbin 101.

Figure 3:
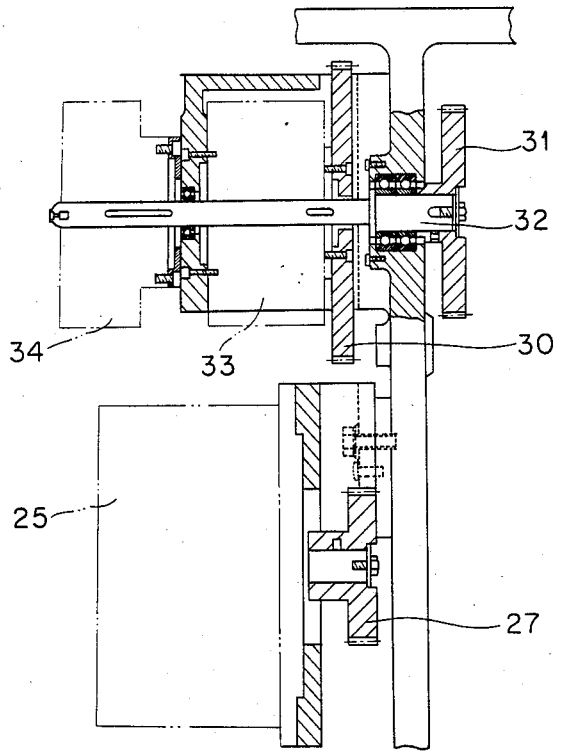

The gear 30 is loosely fitted on a shaft 32, while the gear 31 is fixed to the shaft 32, as shown in FIG. 3. Further mounted on the shaft 32 are, for example, a powder clutch 33 and a powder brake 34 both employing paramegnetic brake 34 both employing paramagnetic to serve as an adjusting means 50 which indiscretely changes torque and brake forces of the bobbin 1 by means of an electric current. When the powder clutch 33 operates, the gear 30 is fixed to the shaft 32 and the rotation of the motor 25 is transferred to one bobbin 1 through gears 27, 28, 29, 30 and 31. When the powder clutch 33 is not in operation, the gear 30 merely rotates relative to the shaft 32 and the rotation of the motor 25 is not transferred to one bobbin 1. When the powder brake 34 operates, the rotation of the bobbin 1 is braked through the shaft 32 and gear 31.

The gears 130 and 131 for transferring the rotation to the other bobbin 101 are also of the same construction. Mounted on a shaft 132 are a powder clutch 133 and a powder brake 134 (for both see FIG. 4) both constituting an adjusting means 150 which changes torque and brake forces of the bobbin 101.

Fixed to the shaft 32 and 132 for coaxial rotation therewith are plates 36 and 136 of winding diameter detecting means 35 and 135 which detect winding diameters of the bobbins 1 and 101, as shown in FIG. 2. The winding diameter detecting means 35 and 135 are composed of the plates 36 and 136, photo switches 37 and 137 for detecting one rotation of the plates 36 and 136, and a rotary encoder 38 for detecting a mechanical rotation angle, the rotary encoder 38 being connected to a shaft portion of a gear which is in 1 : 1 relation to the revolution of a motor for driving the wrapping material feed system.

Detected signals from the photo switches 37, 137 and rotary encoder 38 are fed to a control means 39 (see FIG. 4), which in turn calculates a winding diameter r in the following manner on the basis of a mechanical rotation angle per rotation of bobbin. If the amount of delivery per mechanical rotation of the wrapping material feed system is L, which is controlled constant, the mechanical rotation angle (revolution) per rotation of bobbin is in the following relationship to the winding diameter r:

$$2\pi r = L \cdot P_M / P_{CM}$$

wherein $P_M$ represents the number pulses per rotation of bobbin and $P_{CM}$ represents the number of pulses per mechanical rotation.

Therefore, once $P_M/P_{CM}$ is obtained in accordance with signals provided from the photo switches 37, 137 and rotary encoder 38, the winding diameter r can be calculated as follows:

$$r = L \cdot P_M / P_{CM} \cdot 1/2\pi 1$$

Figure 5:
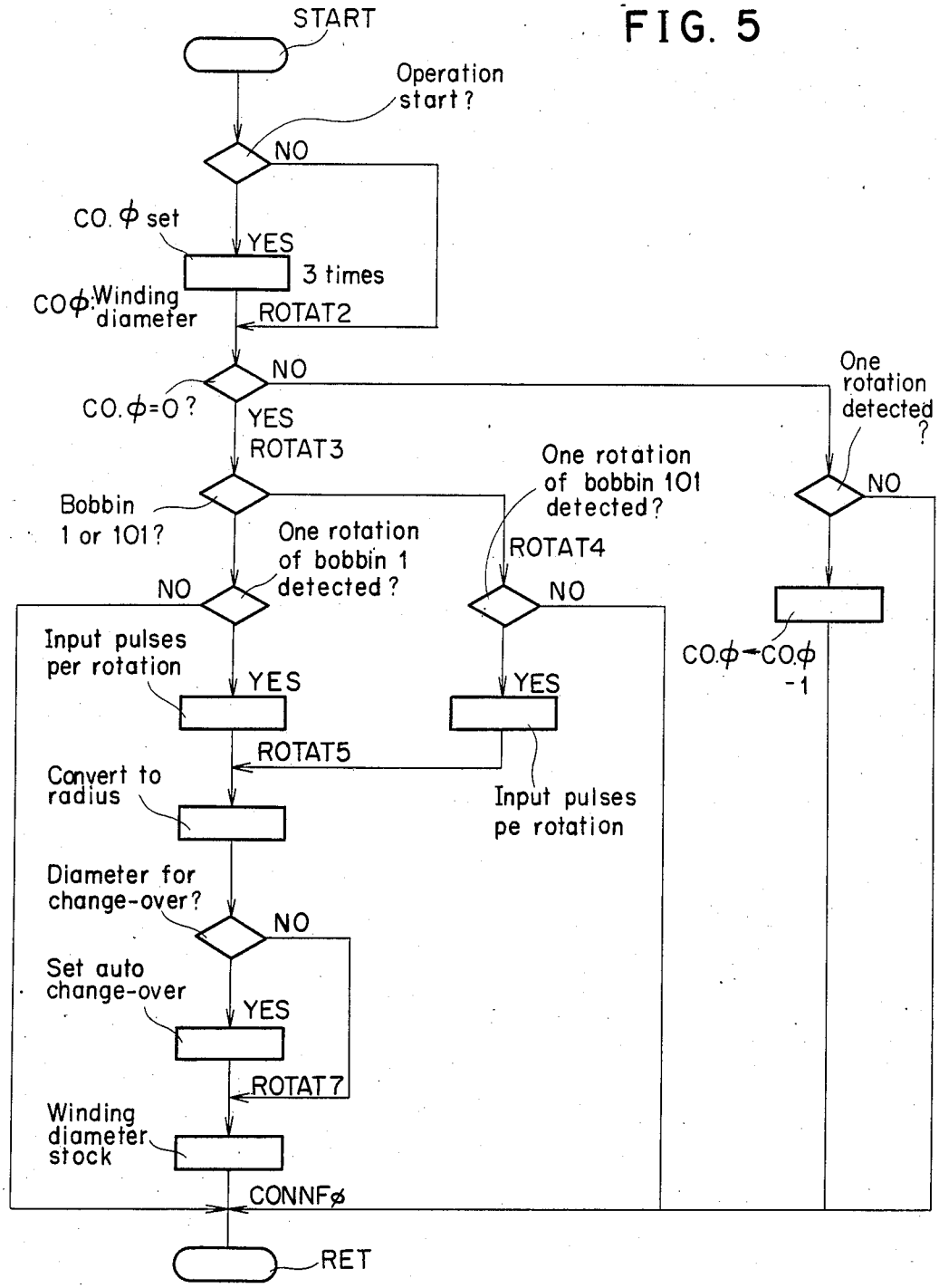

FIG. 5 shows a calculation routine for this winding diameter, r. The calculation of the winding diameter r is not performed until operation becomes stable at the start of operation of the wrapping material feed system.

The control means 39, which is constituted by a microcomputer 40, has a pulse motor card 41, a rotary encoder card 42, an IN card 43 and a CPU card 44 (comprising CPU 45, ROM 46 and RAM 47). It not only performs the above calculations but also controls the powder clutch 33, 133 and powder brakes 34, 134.

In the ROM 46 and RAM 47 are stored optimum torque and brake forces for winding diameters of the bobbins 1 and 101 as well as increment and decrement patterns of torque and brake forces of the bobbins 1 and 101 for various operation modes (start-up, normal operation, stop and change-over) of the wrapping material feed system.

Figure 6:
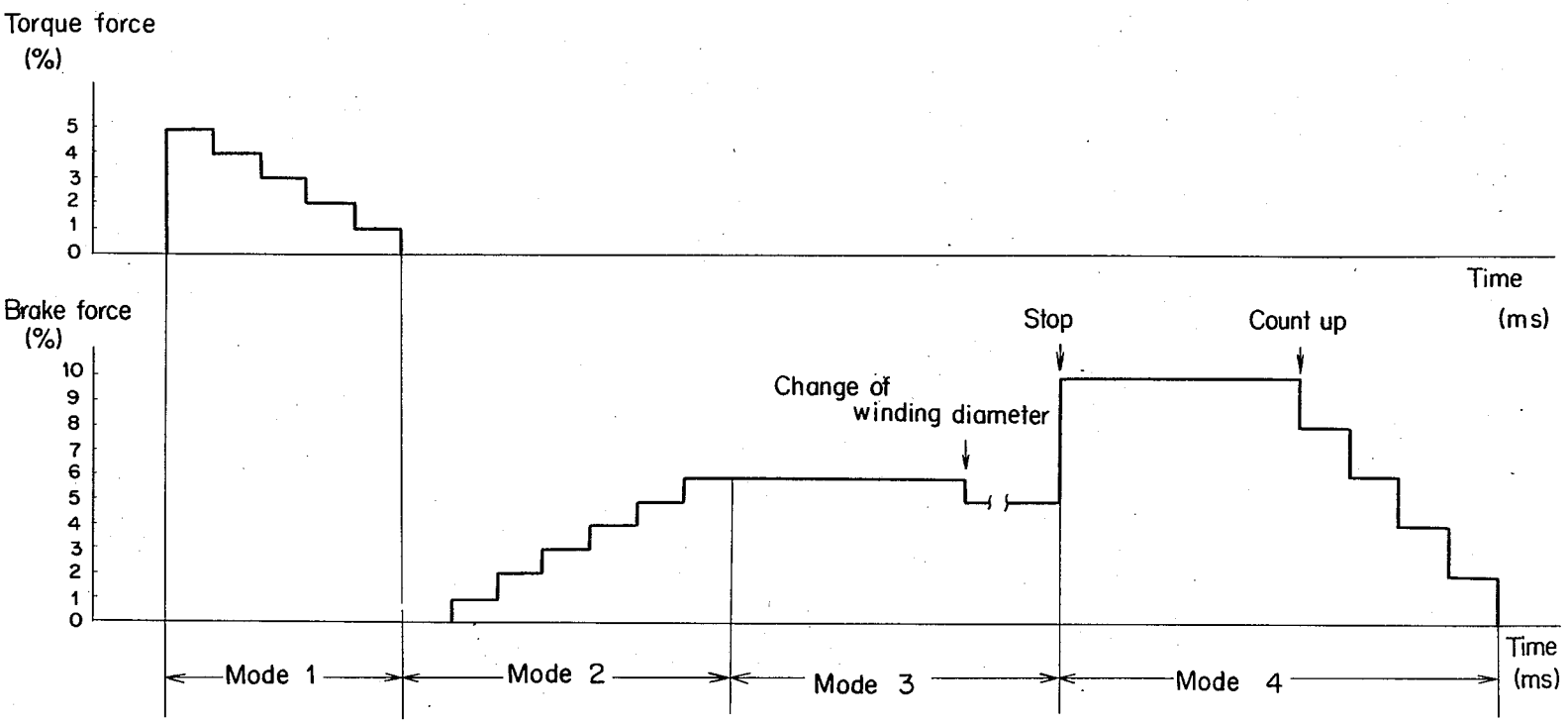

FIG. 6 shows contents of control for the powder clutches 33, 133 and powder brakes 34, 134 in various operation modes of the wrapping material feed system.

At the time of start-up (modes 1 and 2), a large load is applied to the bobbins 1 and 101, so in order to prevent the amount of delivery from being decreased by slipping of the wrapping materials 2 and 102 to produce a shorter piece, the bobbins 1 and 101 are driven first at a large torque by the powder clutches 33 and 133, thereafter the torque force is decreased gradually, and when the torque force becomes zero (when the clutches are turned OFF), the brake force is increased gradually by the powder brakes 34 and 134. In this case, an optimum torque for the winding diameter of each of the bobbins 1 and 101 is read from the RAM 47 and is set to a timer of the CPU 45, then at every predetermined time (e.g. 100 ms) the torque force is decreased by 1 to 2% or so and when the torque force becomes zero, the brake force is set initially at 0%. Then, at every predetermined time (e.g. 100 ms) the brake force is increased by 1 to 2% or so and this is repeated until optimum brake force is obtained, whereupon the brake force is rendered constant.

In normal operation (mode 3), optimum brake forces proportional to winding diameters are read from the RAM 47 and the powder brakes 34 and 134 are thereby controlled to remove the unevenness in rotation of the bobbins 1 and 101 such that the wrapping material is rotated at a constant peripheral speed.

In stopping (mode 4), a large brake force is applied initially and after the lapse of a certain time the powder brakes 34 and 134 are controlled so as to weaken the brake force gradually to thereby suppress the loosening of the tension rollers 18 and 118 (see FIG. 1). In this case, upon input of Stop signal (failure stop or manual stop), the brake force in stop condition is read from the RAM 47 and it is set to a timer of the CPU 45, then after counting up of a stop counter value, the brake force is decreased by 2% or so at every certain time (e.g. 100 ms).

Figure 4:
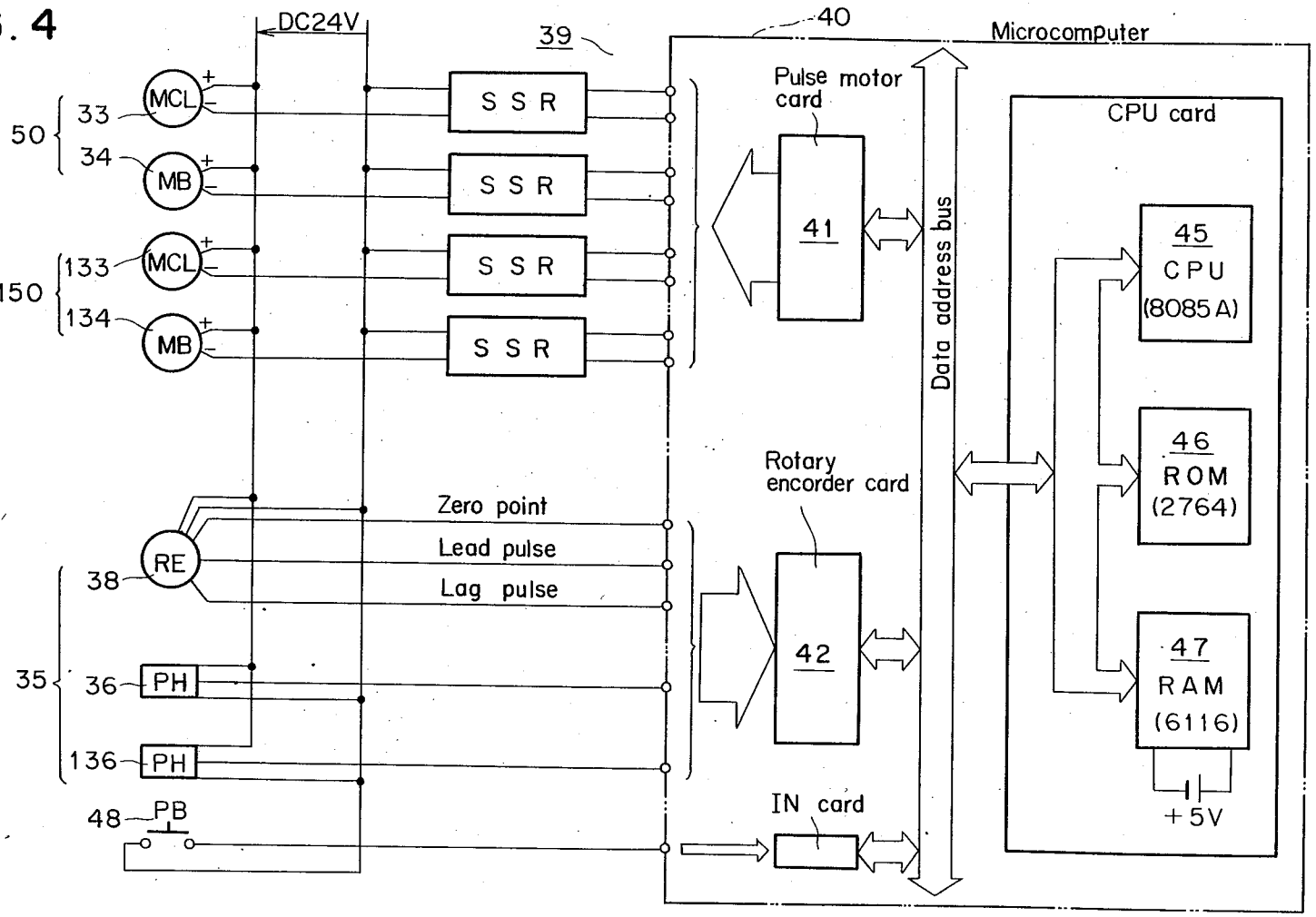

At the time of switching from bobbin 1 to bobbin 101, Auto Change-over signal or Manual Change-over signal (provided by turning ON a manual change-over button 48 shown in FIG. 4) is set, whereupon the bobbin 101 is started operation by the same contents of control as that for the bobbin 1, and upon completion of the change-over the control is switched to the bobbin 101.

Figure 7:
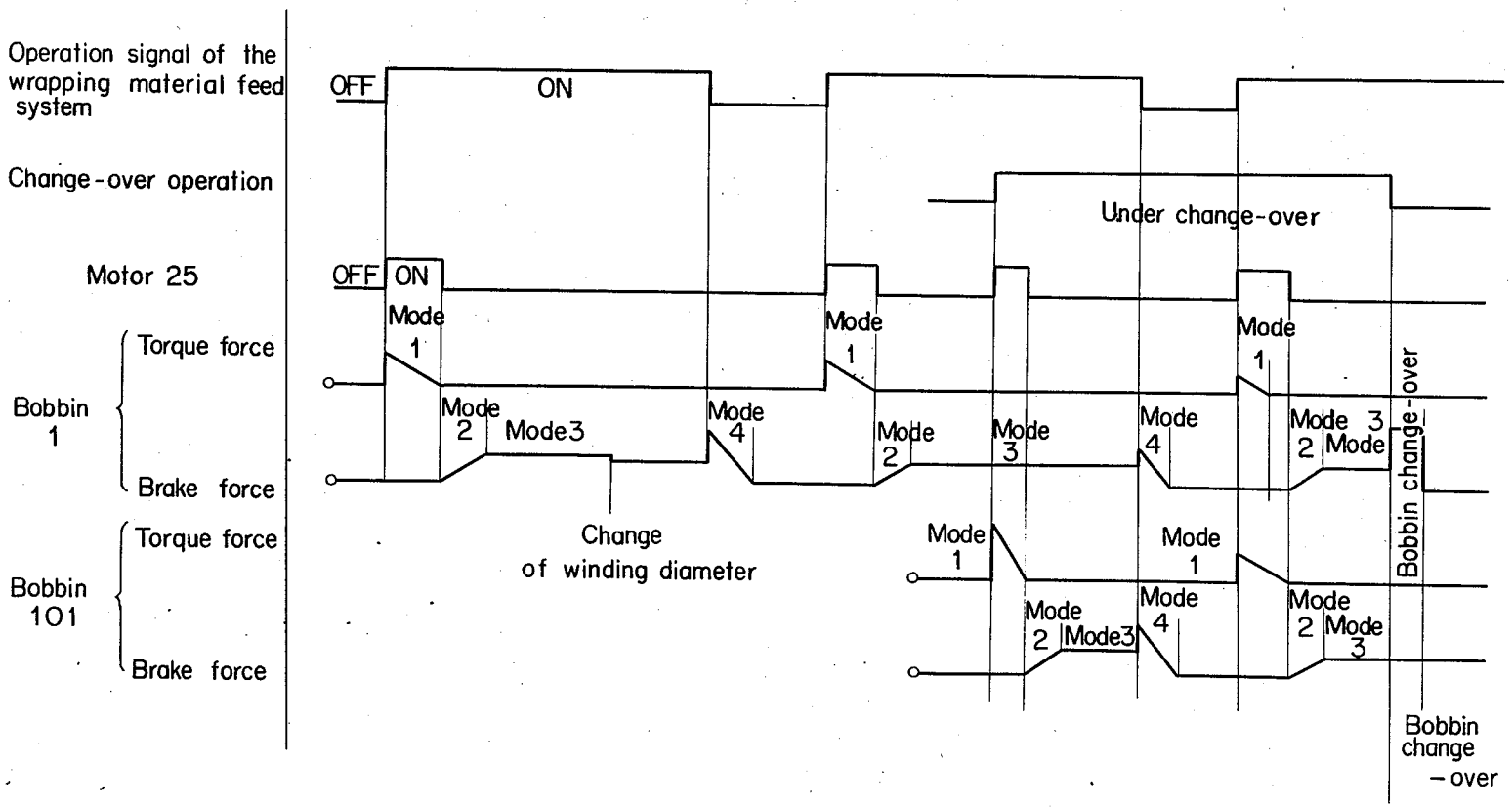

The operation of the delivery amount controlling apparatus of the above construction will be described below with reference to the timing chart of FIG. 7 and the flowcharts of FIGS. 8 to 12.

Figure 9:
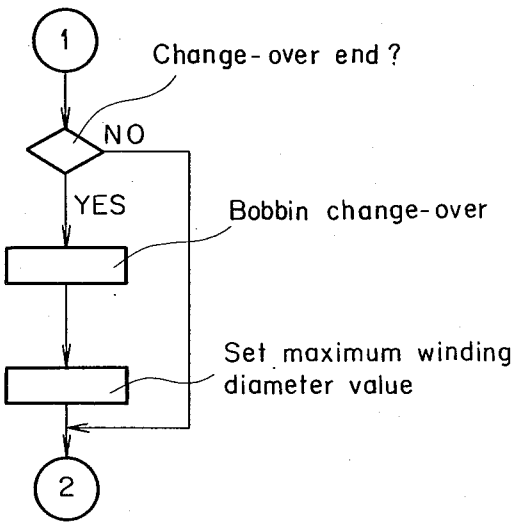
Figure 8:
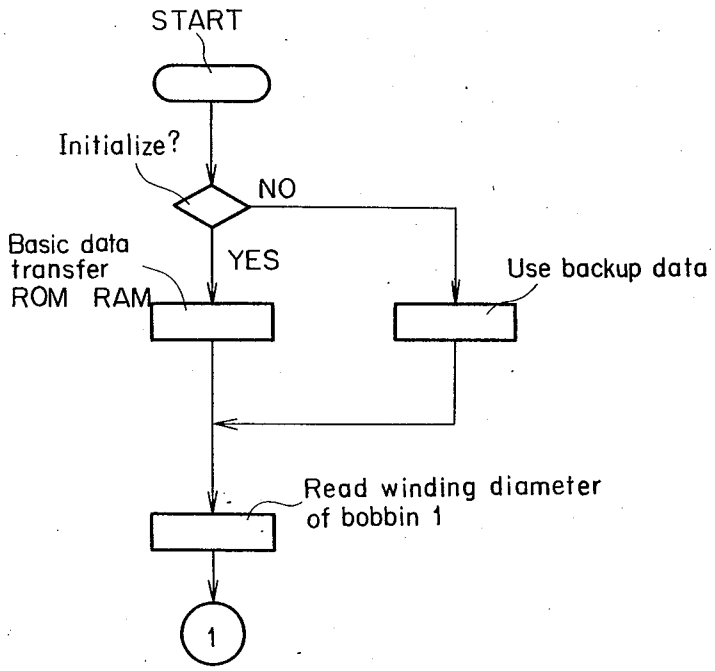

FIGS. 8 and 9 each show a delivery amount controlling subroutine. First, initialization is performed and the data stored in the ROM 46 are transferred to the RAM 47, then the winding diameter of the bobbin 1 is read. Thereafter, when the change-over has been completed, the control is switched from bobbin 1 to bobbin 101 and the maximum value of winding diameter is set.

Figure 10:
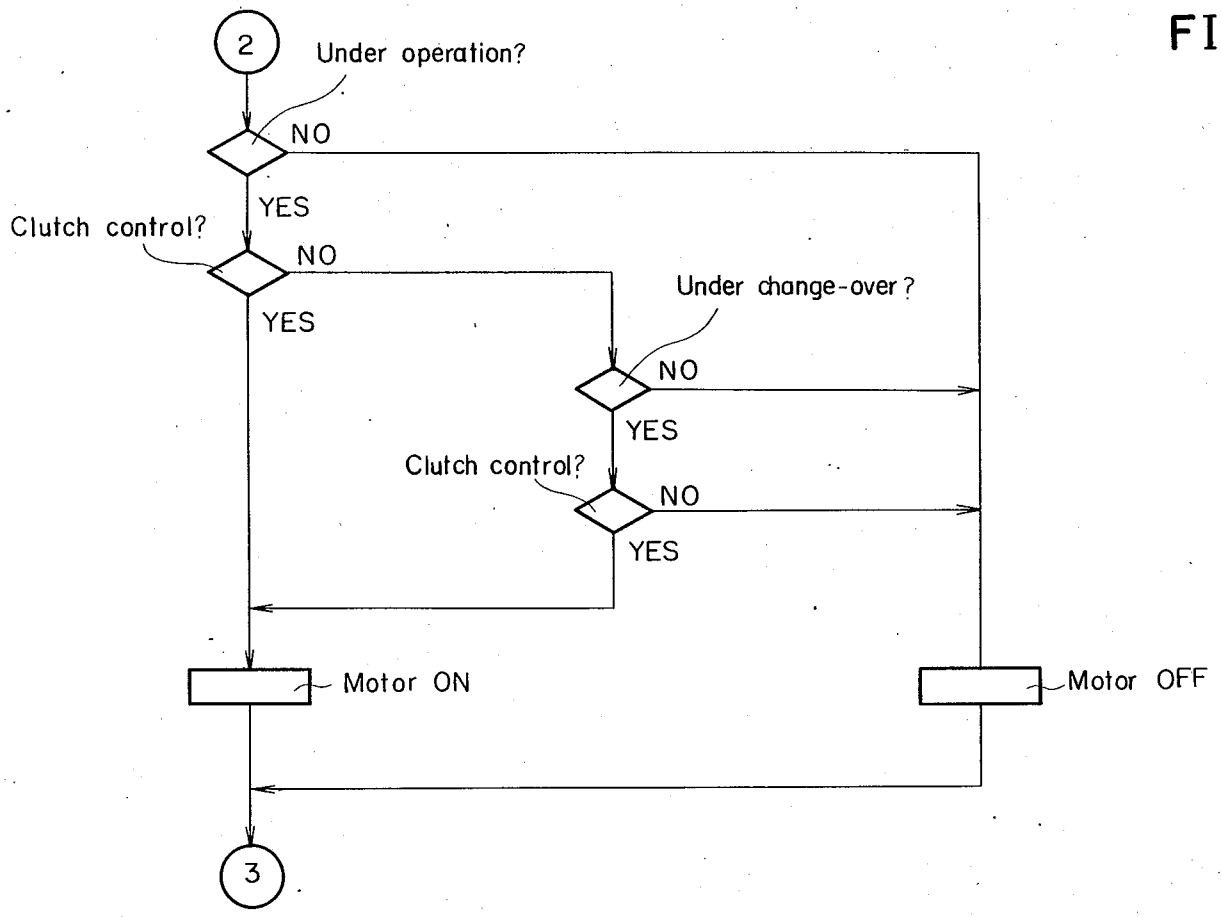

FIGS. 6 and 10 show control for the motor 25. The motor 25 stops except when the control for the powder clutches 33 and 133 is performed during operation of the wrapping material feed system.

Figure 11:
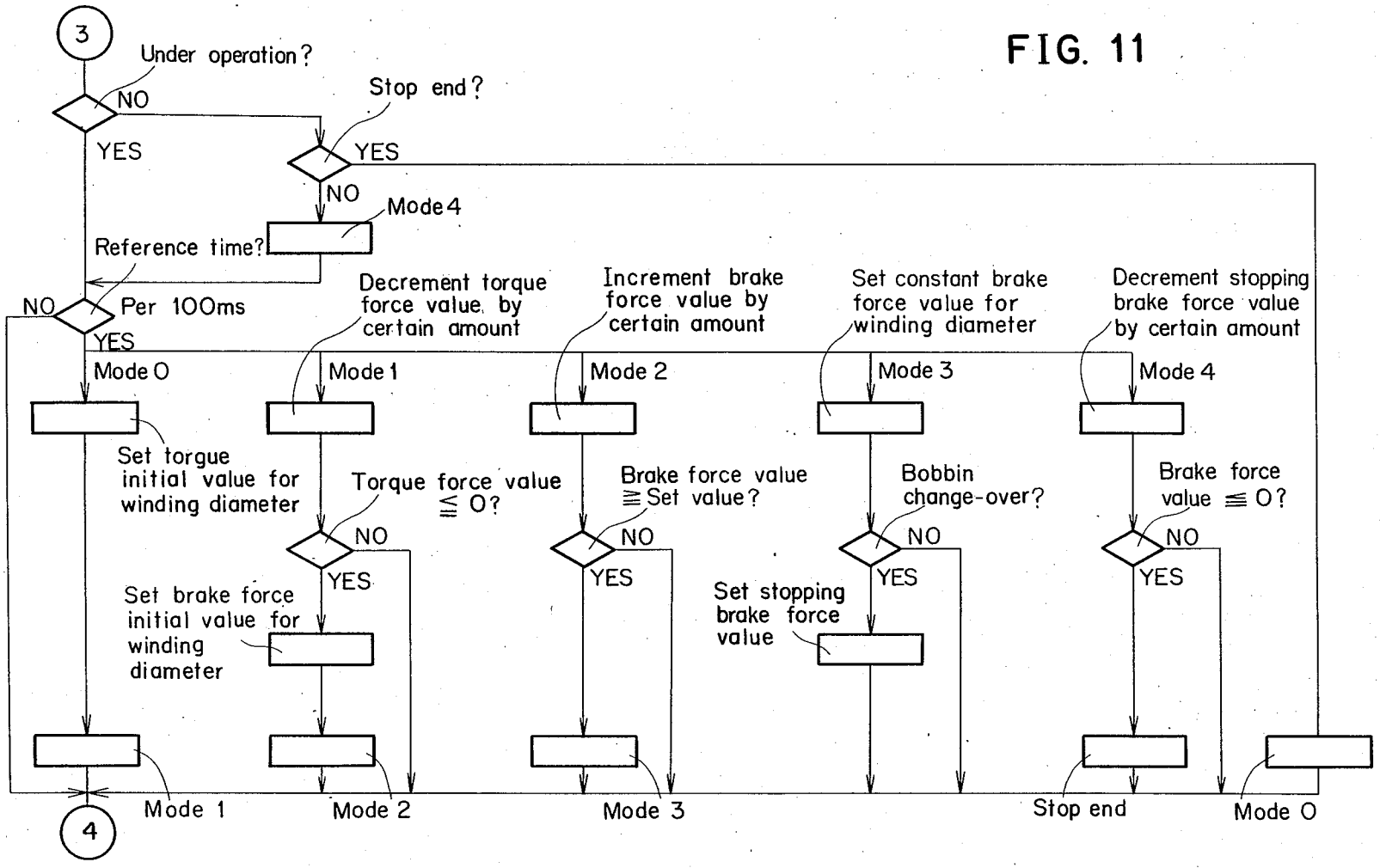

FIGS. 6 and 11 show control for the bobbin 1. First, an initial value of an optimum torque force proportional to the winding diameter is set and when the wrapping material feed system is in a state of start-up, the powder clutch 33 is controlled with the said initial value to transfer the rotation of the motor 25 to the bobbin 1. The bobbin 1 is rotated by both this rotational force from the motor 25 and the delivery force induced by the feed roller 12 and receiving roller 13, thereby allowing the wrapping material 2 to be drawn out. And every time a certain time is elapsed, the above initial value is subtracted by a certain amount to weaken the torque force, thereby allowing the bobbin 1 to be rotated by the delivery force induced by the feed roller 12 and receiving roller 13 to draw out the wrapping material 2. When the torque force becomes zero (at this time the motor 25 stops so that the bobbin 1 is rotated by only the delivery force of the feed roller 12 and receiving roller 13), an initial value of an optimum brake force proportional to the winding diameter is set and every time a certain time is elapsed, the brake force is incremented to control the powder brake 34 thereby braking the rotation of the bobbin 1. When the brake force becomes the initial value, the powder brake 35 is controlled so that the brake force becomes constant. In normal operation, the brake force is reset every time the winding diameter becomes smaller by say 4 mm or so to suppress the unevenness of rotation.

When the winding diameter becomes small and switching is to be made from bobbin 1 to bobbin 101, first a stopping brake force value is set. This brake force is larger than that in normal operation, so the rotation of the bobbin 1 is slowed down rapidly and after the lapse of a predetermined time the said brake force is subtracted by a predetermined time and finally becomes zero, whereupon the bobbin 1 stops.

By controlling the torque and brake forces of the bobbin 1 in the above manner, it is made possible to minimize the variation in the delivery amount even under a larger winding diameter and so even with the tension roller 18 alone, the purpose can be fully attained.

Figure 12:
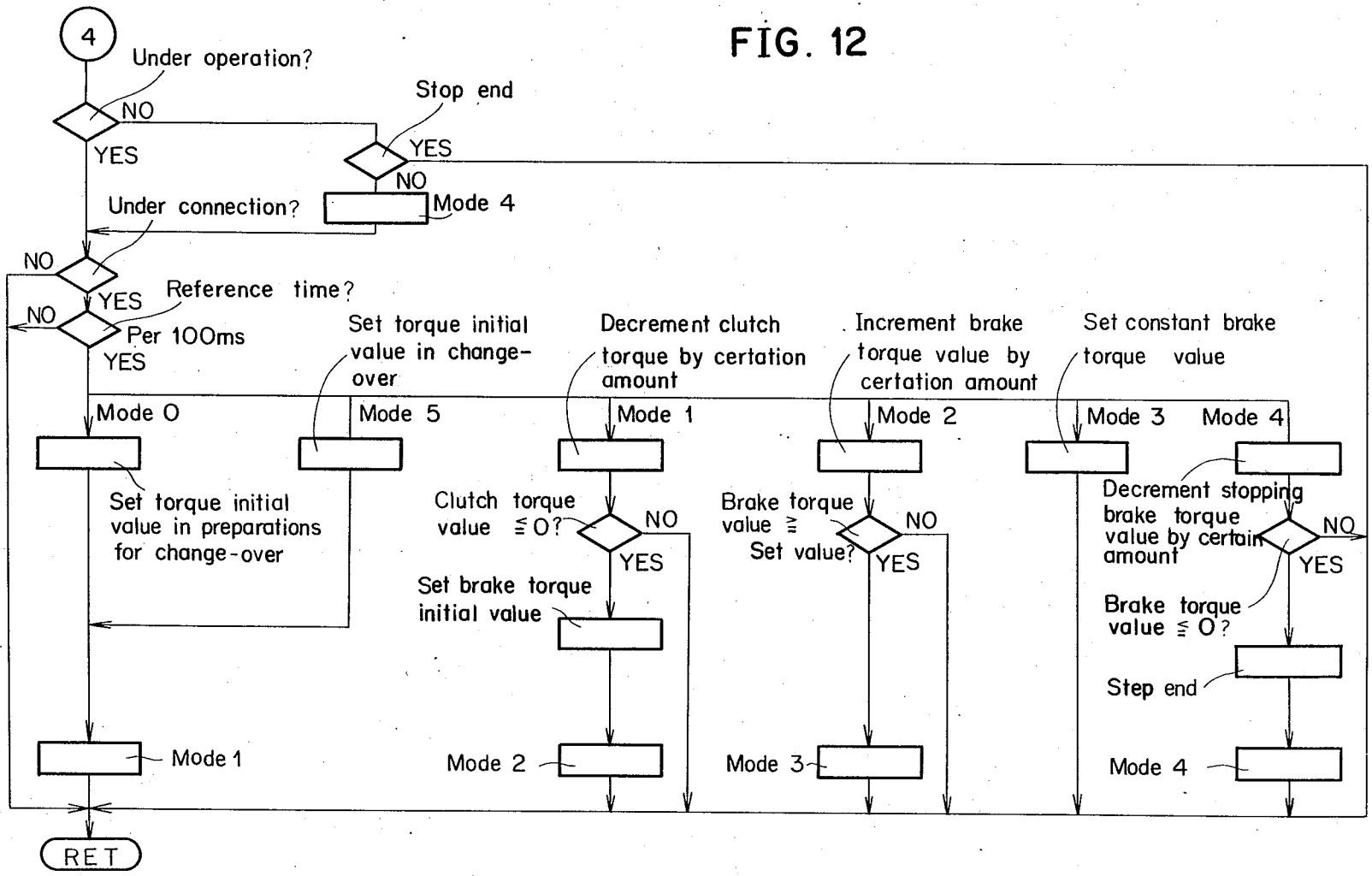

As to control for the bobbin 101, it is shown in FIGS. 6 and 12. In this control, during preparations for change-over, the powder clutch 133 is controlled to transfer the rotation of the motor 25 to the bobbin 101. The bobbin 101 is rotated by both this rotational force from the motor 25 and the delivery force induced by the connection feed roller 105 and receiving roller 106, thereby allowing the wrapping material 102 to be drawn out. In this case, there is performed the same control as in the case of the bobbin 1 described previously.

At the time of change-over after completion of the preparations for change-over, the rotation of the motor 25 is transmitted to the bobbin 101 by means of the powder clutch 133, followed by control in the same manner as in the case of bobbin 1. The powder clutch and brake may be replaced by a hysteresis clutch and a hysteresis brake.

Thus in the above embodiment the winding diameter detecting means 35 and 135 are composed of the plates 35 and 135 which rotate together with the bobbins 1 and 101; the photo switches 37 and 137 which detect one rotation of the plates 35 and 135; and the rotary encoder 38 which detects a mechanical rotation angle of the wrapping material feed system. But this construction does not constitute any limitation. For example, there may be adopted a construction in which a plurality of sensors for detecting a wrapping material are disposed at suitable intervalves in the radial direction of bobbin to detect winding diameters, or a construction in which a level is brought into abutment with the wrapping material on bobbin and a pivotal motion of the lever with variation in winding diameter is detected to thereby detect a winding diameter, or a construction in which the number of pulses from an encoder for detecting a mechanical rotation angle of the wrapping material system and that from an encoder for detecting a rotational angle of bobbin are compared with each other to calculate a winding diameter, or a construction in which ratio wave, acoustic wave or light is directed to the wrapping material on bobbin and the distance between the illumination source and the wrapping material is determined, from which distance is then calculated a winding diameter.

According to the present invention, as set forth hereinabove, the torque and brake forces of bobbin are controlled according to operation modes of the wrapping material feed system and winding diameter on bobbin to thereby control the amount of delivery, so the variation in the amount of delivery can be kept to a minimum, and consequently it is not necessary to use a number of tension rollers even under a large winding diameter.

What is claimed is:

1. An apparatus for controlling the amount of delivery in a wrapping material feed system, said apparatus comprising:

bobbin means wound with wrapping material therearound;

rotation drive means to produce a predetermined torque;

a transmission mechanism connected to an axis of said bobbin means to transmit said predetermined torque to said bobbin means;

clutch means and brake means provided within said transmission mechanism, said clutch means being adapted to transmit said predetermined torque in discretely variable fashion to said bobbin means;

sensor means for detecting a diameter of the wrapping material wound around said bobbin; and control means for controlling said clutch means and said brake means to provide said bobbin means with an optimum torque in accordance with the detected diameter of the wrapping material such that said wrapping material is rotated at a constant peripheral speed.

2. An apparatus according to claim 1, wherein said bobbin means includes a pair of bobbins.

3. An apparatus according claim 2, wherein said torque transmission mechanism includes common gear means in mesh with said rotation drive means and a pair of drive gear means in mesh with said respective bobbins.

4. An apparatus for controlling the amount of delivery in a wrapping material feed system, said apparatus comprising:

bobbin means wound with wrapping material therearound;

rotation drive means to produce a predetermined torque;

a transmission mechanism to transmit said predetermined torque to said bobbin means;

clutch means and brake means provided within said transmission mechanism, said clutch means being adapted to transmit said predetermined torque in discretely variable fashion to said bobbin means;

sensor means for detecting a diameter of the wrapping material wound around said bobbin; and control means for controlling said clutch means and said brake means to provide said bobbin means with an optimum torque in accordance with the detected diameter of the wrapping material such that said wrapping material is rotated at a constant peripheral speed wherein said bobbin means includes a pair of bobbins, wherein said torque transmission mechanism includes common gear means in mesh with said rotation drive means and a pair of drive gear means in mesh with said respective bobbins and wherein said clutch means and said brake means include a powder clutch and a powder brake, respectively.

5. An apparatus according to claim 3, wherein said sensor means includes a plate attached to each drive gear for coaxial rotation therewith, a photo switch to detect said coaxial rotation of the plate, and a rotary encoder provided in association with the rotation drive means.

6. An apparatus according to claim 1, wherein said control means includes a memory storing a torque and braking force variation pattern prepared in accordance with an operation mode including a start-up mode, a normal operation mode, a stop mode, and a change-over mode to provide the bobbin means with an optimum torque in accordance with the diameter detected by the sensor means.

* * * * *